US006332381B1

(12) United States Patent
Vasudeva

(10) Patent No.: US 6,332,381 B1
(45) Date of Patent: Dec. 25, 2001

(54) HEX KEY GRIPPING AID

(75) Inventor: Kailash C. Vasudeva, Waterloo (CA)

(73) Assignee: Maxtech Manufacturing Inc., Waterloo (CA)

( * ) Notice: Subject to any disclaimer, the term of this patent is extended or adjusted under 35 U.S.C. 154(b) by 0 days.

(21) Appl. No.: 09/286,429

(22) Filed: Apr. 6, 1999

(51) Int. Cl.[7] ..... B25B 23/16
(52) U.S. Cl. ..... 81/177.2; 81/177.1; 81/489
(58) Field of Search ..... 81/177.1, 177.2, 81/177.4, 439, 440, 489, 490, 491

(56) References Cited

U.S. PATENT DOCUMENTS

| | | | | |
|---|---|---|---|---|
| 1,172,656 | * | 2/1916 | Yorgensen | 81/177.2 |
| 2,409,613 | * | 10/1946 | Brooks | 81/177.4 |
| 2,715,028 | * | 8/1955 | Dossie | 81/177.4 |
| 2,842,020 | * | 7/1958 | Tarquinio | 81/177.2 |
| 3,766,811 | * | 10/1973 | Callahan | 81/177.2 |
| 3,850,056 | * | 11/1974 | Allen | 81/177.2 |
| 5,524,513 | * | 6/1996 | Barahona | 81/177.4 |
| 5,592,859 | | 1/1997 | Johnson et al. . | |
| 5,911,799 | * | 6/1999 | Johnson et al. | 81/177.2 |
| 6,062,111 | * | 5/2000 | Wershe | 81/177.2 |

OTHER PUBLICATIONS

Marketing flyer "Allen–Pal" printed 7/98 (2 pages).

* cited by examiner

*Primary Examiner*—Joseph J. Hail, III
*Assistant Examiner*—Joni B. Danganan
(74) *Attorney, Agent, or Firm*—R. Craig Armstrong

(57) ABSTRACT

Hex keys or like tools of various sizes may be inserted into the gripping aid, to provide a better grip and additional torque when using such tools. The device has an elongated body with hex key accepting slots at each end and longitudinal cavities of different dimensions for an arm of the hex key. In a preferred embodiment, a locking collar to secure the hex key in place in the body is provided. The locking collar has openings extending across its face which rotate from a hex key accepting position to a hex key locking position.

12 Claims, 11 Drawing Sheets

HEX KEY GRIPPING AID

BACKGROUND OF THE INVENTION

1. Field of the Invention

This invention relates to a device into which hex keys or other like tools of various sizes may be inserted, so that the device provides a better means for gripping the tool and applying torque.

A hex key typically is L-shaped, having a long portion, and a short arm at ninety degrees to the long portion. The hex key may be gripped by either portion, depending on which arm is being inserted into the hex head bolt or other hexagonal recess. Gripping the hex key and applying torque is difficult, particularly if the short arm is being gripped.

The invention can be readily adapted to uses with similar tools, for example L-shaped or S-shaped tools, with hexagonal or other cross-sectional shapes. However, for convenience, the following description will refer only to "hex keys".

2. Description of the Prior Art

Other devices which accept hex keys to provide a better grip and application of torque are known. For example, U.S. Pat. No. 5,592,859 (Johnson et al.) shows a device including different-sized longitudinal slots to accommodate different-sized hex keys, located at various positions along the outer surface of the length of the device. In use, one portion of the hex key lies in a slot along the upper surface of the device, and the other portion extends through a suitably-positioned hole through the device. A hex key, once inserted into the applicable slot, is fixed in place by means of a sliding lock which overlies the portion of the hex key which is in the slot.

SUMMARY OF THE INVENTION

It is an object of the invention to provide an improved device for gripping various-sized hex keys or other like tools, to provide a better grip and additional torque when using the tool.

In the preferred embodiment of the invention, an elongated body has a plurality of hex key accepting slots of different sizes extending longitudinally into the body from at least one end thereof, and preferably from both ends thereof. Preferably, each end with hex key accepting slots has a slotted collar, rotatable about the axis of the body, to capture a hex key once installed, as will be described in greater detail in the detailed description which follows.

In some embodiments of the invention, the device also acts as a holder for displaying multiple hex keys at the point-of sale and/or for storing them subsequently. The body of the device may include means for attaching the device to a plastic storage case and/or a point-of-sale display holder or the like.

Further features of the invention and variations thereon will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION

First Embodiment

Figure 1:
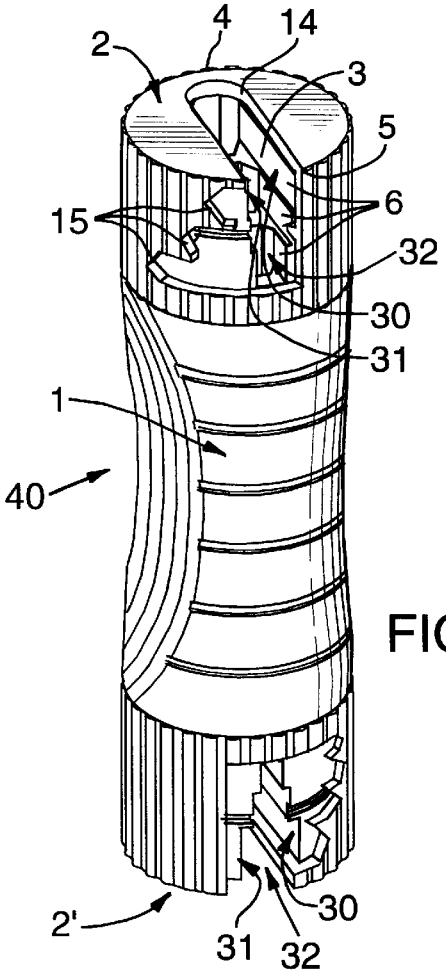
FIG. 1 is a perspective view of a first preferred embodiment of the invention, showing the rotatable collars in the "open" or hex key accepting positions.

A first preferred embodiment of a device for assisting in gripping and applying torque to a hex key or the like is shown in FIGS. 1–10. The device has an elongated body 40 comprising a central grip portion 1, a first end 2 and a second end 2' opposite to the first end. One or preferably both ends have at least one first slot 3 providing access to a plurality of lateral channels 6 of different cross-sectional sizes, stepped longitudinally into the body. A second slot 32 is arranged longitudinally in the side of the elongated body 40, to allow access to the plurality of channels. The channels are sequentially arranged in a direction from the respective end towards the central portion of the body, in order of decreasing width. Each of the channels 6 has a first wall surface 30 and a second wall surface 31 to provide contact surfaces for the sides of an installed hex key. A cavity 33 extends from each of the channels 6, and each cavity runs longitudinally into the body. The cavities are intended to receive one arm of a hex key. Preferably there are as many cavities as channels at each end 2, 2', and the cavities are generally longitudinally aligned with each other and have a respective width corresponding to the diameter of their corresponding hex key. The cross-section of the cavities 33 is preferably hexagonal, but any cross-section which corresponds to the intended inserted tool may be used.

Figure 8:
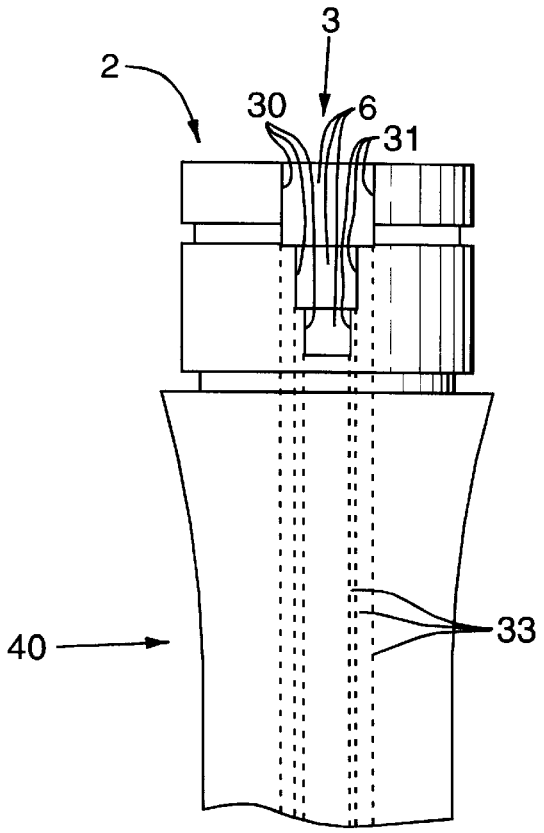
FIG. 8 is a side view of the first preferred embodiment of the invention, with the collar removed.
Figure 9:
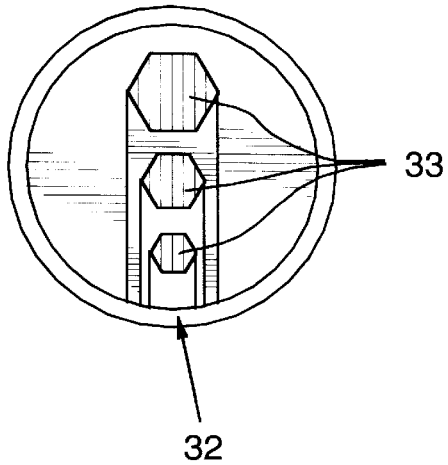
FIG. 9 is an end view corresponding to FIG. 8, again with the collar removed.
Figure 10:
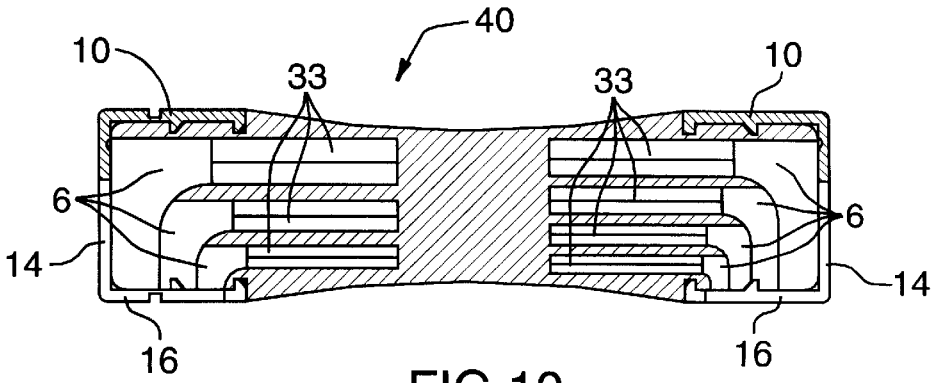
FIG. 10 is a longitudinal cross section through the first preferred embodiment.
Figure 11:
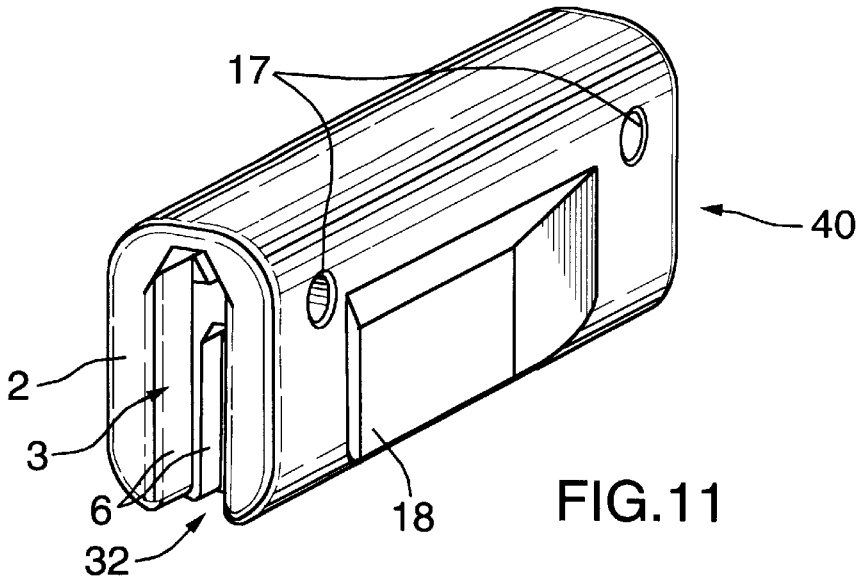
FIG. 11 is a perspective view of a second preferred embodiment according to the invention.

Thus as seen most clearly in FIG. 8, there is a "stepped" configuration. When a hex key 7 is inserted into the applicable cavity 33, the inserted portion of the hex key extends parallel to the length of the body, and thus the operable perpendicular portion of the hex key extends laterally, i.e. perpendicular to the length of the body, through its respective channel 6 and thence away from the body. Preferably one end of the body has four cavities 33 and the other end has three cavities 33. This accommodates a set of seven hex keys, with the seven cavity sizes alternating from end to end, i.e. largest at the first end 2, next largest at the second end 2', then back to the first end for the third cavity, etc.

Figure 5:
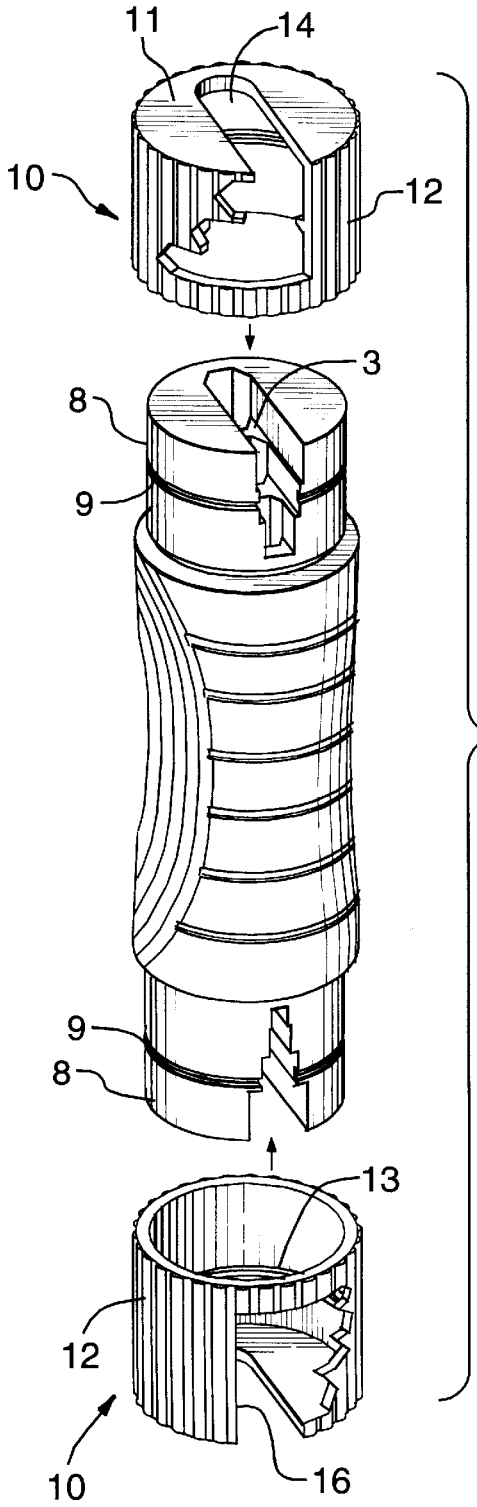
FIG. 5 is an exploded perspective view of the first preferred embodiment showing the collars removed from the body of the device.

Preferably, a locking collar 10 is provided, although it should be clearly understood that a locking collar is not a strict requirement, and the device is workable without one. As shown in FIG. 5, a portion 8 of the body 40 extending from each end 2, 2' towards the middle of the body is circular in cross section and has at least one groove 9 extending around the circumference. These portions 8 are shaped in order to allow collars 10 to be fitted over them. The collars are thus arranged to fit over each portion B of the body, so that a face 11 of the collar covers the end of the body and a side 12 of the collar extends around the circumference of the body. The grooves 9 are positioned to accommodate a tongue 13 extending around the interior surface of the collar 10, so that each collar is held in place on the body when the tongue is seated in the groove. Once the collars are placed on each portion 8, the collars are rotatable relative to the body from a hex key accepting position to hex key locking positions. Each collar has a first opening 14 extending from one edge of the face 11 of the collar across the collar face through to the other edge. The width of this first opening across the face of the collar is wider than the cross section of the largest hex key to be inserted into the body. The collar 10 further has a second opening 16 arranged in the side therof and connecting to the first opening 14 at one end thereof. The second opening has a series of V-shaped notches 15 along one side of the second opening. These V-shaped notches are designed to cooperate with an inserted hex key when the collar is rotated into the hex key locking position, to provide additional stability and to secure the hex key. When the hex key 7 is to be removed, the collar is rotated to its hex key accepting position, where the V-shaped notch 15 is not in contact with the hex key. Preferably, each different-sized hex key has a different locking position, owing to a staggered positioning of the V-shaped notches 15 in the collar 10.

Figure 2:
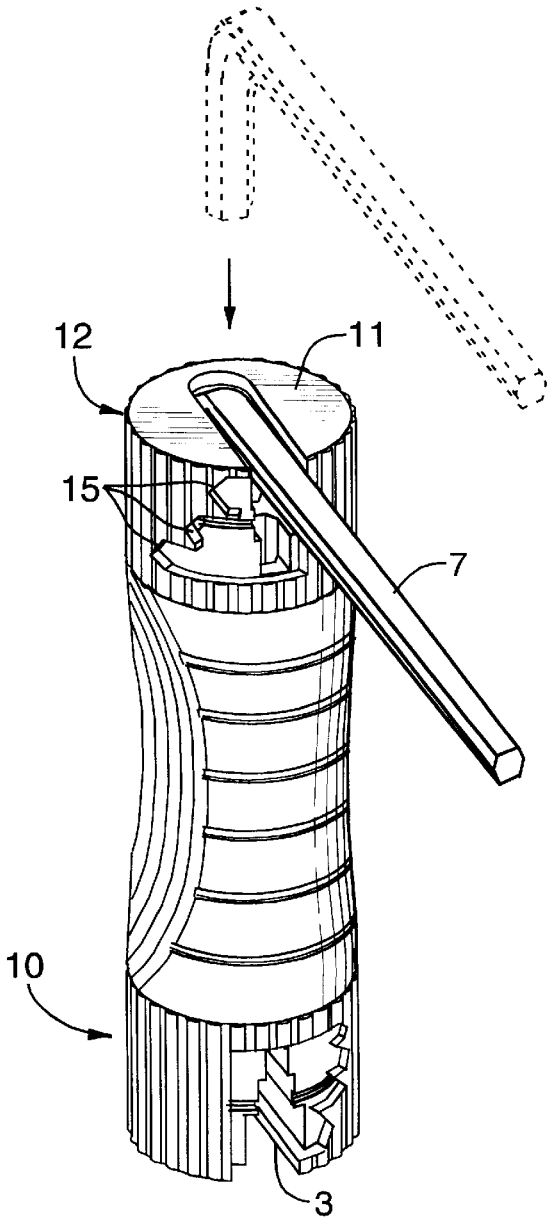
FIG. 2 is a perspective view corresponding to FIG. 1, showing a hex key with its short arm being inserted into the body.
Figure 3:
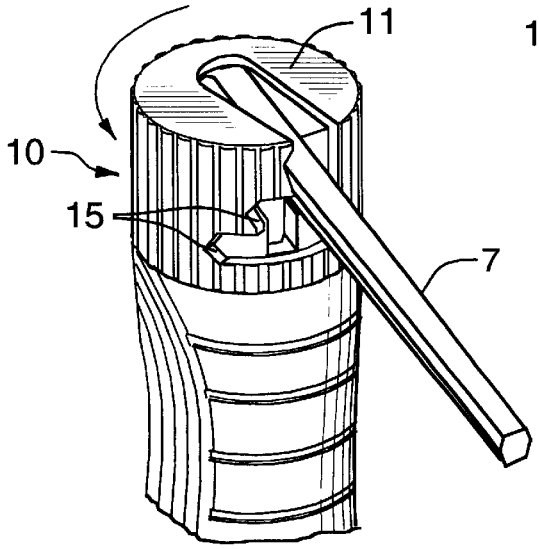
FIG. 3 is a perspective view corresponding to FIG. 2, showing the collar rotated to a "locked" position, to lock the hex key in place.
Figure 6:
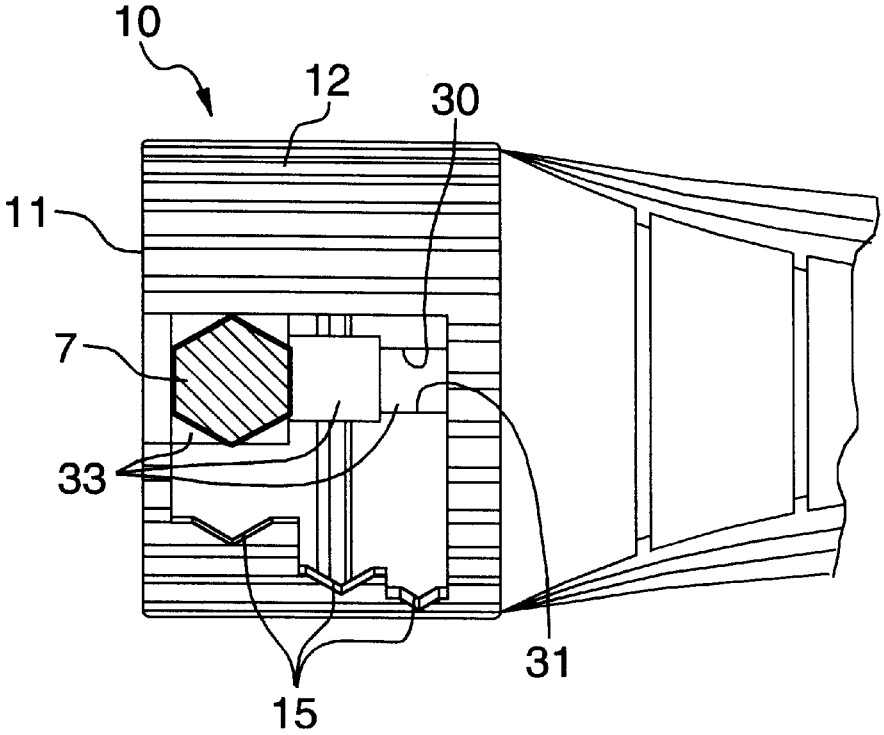
FIG. 6 is a side view of one end of the device according to FIG. 1, showing a hex key inserted and the collar in the open position.
Figure 7:
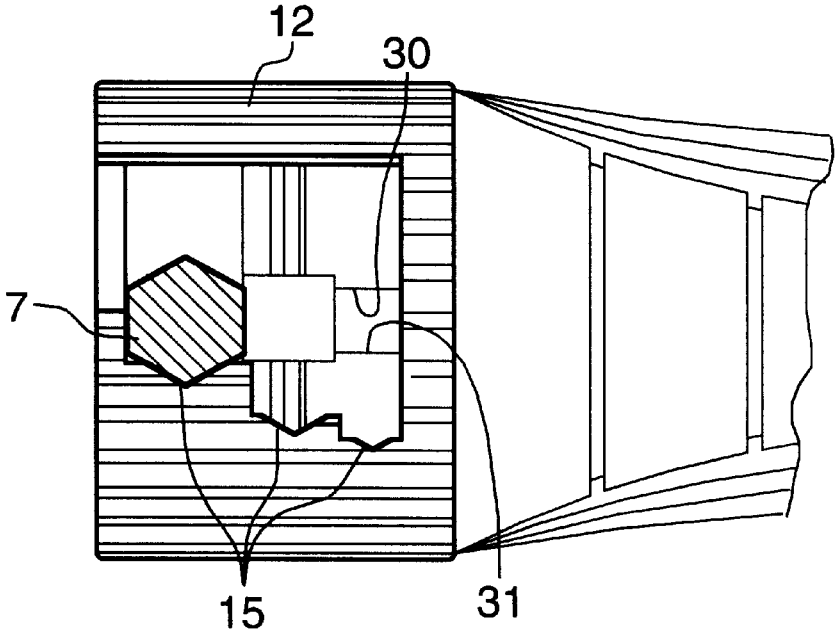
FIG. 7 is a side view corresponding to FIG. 6, showing the hex key inserted and the collar in the locked position.

In FIGS. 2 and 6, the first embodiment of the device is shown in the hex key accepting position. The collar opening 14 is aligned with the hex key accepting channel 6 and thus the row of hex key cavities 33 at each end of the body. This allows for inserting the hex key into its applicable cavity. The collar 10 is rotated to its hex key locking position, as shown in FIGS. 3 and 7, when an arm of the hex key has been inserted into its applicable slot. A V-shaped notch 15 then presses against the side of the hex key, preventing axial movement thereof.

Once pressed against the inserted hex key, the collar should prevent the hex key from moving. To maintain the position of the collar against the hex key, there should be a considerable amount of friction between the body and the collar. To this end, the fit between the body 40 and the collar 10 is sufficiently close to provide sufficient friction between them to prevent any unintentional rotation of the collar.

Alternatively, other means could be used to ensure that the collars do not move once pressed against an inserted hex key. Examples are a series of ball and spring lock mechanisms positioned on each end of the body, aligned to spring into holes in the face of the collar at suitable positions to lock the collars into various positions. This alternative embodiment of collar gripping means is not shown.

Figure 4:
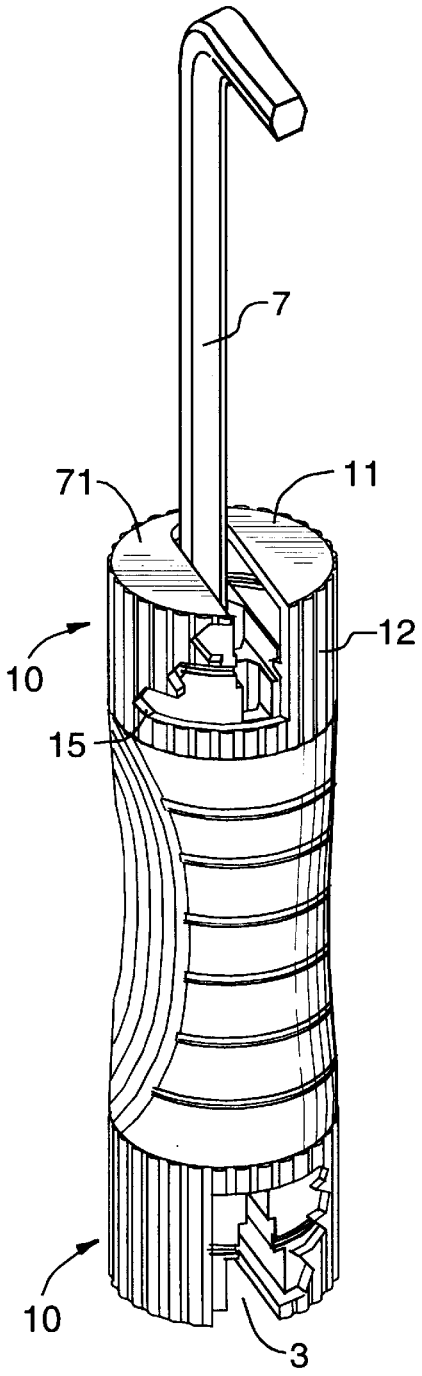
FIG. 4 is perspective view showing the long portion of the hex key in the body.

As shown in FIG. 4, the long arm of the hex key may be inserted into the corresponding cavity if desired, instead of using the short arm. The locking collar 10 is then not used.

Second Embodiment

A second embodiment of the device according to the invention is shown in FIGS. 11–16. As can be appreciated most clearly from a comparison of FIG. 9 with FIG. 14, and FIG. 10 with FIG. 12, this second embodiment is in essence the same as the first embodiment, except that it does not have a locking collar, and its external shape is closer to rectangular in cross-section (although not necessarily so). Reference numerals have been used corresponding to those of FIGS. 1 to 10 for the same technical features. The second embodiment acts as a holder for multiple hex keys, and may be detachably secured to a point-of-sale display holder or card via two blind holes 17 positioned and sized to accept posts (not shown) extending from the display holder or card (also not shown). In this embodiment, the body 40 is shaped as a generally rectangular block. A recess 18 may be located on at least one side of the body, to facilitate gripping.

When acting in its hex key holding function, the second embodiment can accept multiple hex keys to be inserted in the device simultaneously. When hex keys are stored in this embodiment of the device, a portion of each hex key extends out from the body so that they may be viewed and inspected, as shown in FIG. 12.

At each of the two ends 2, 2' of the body, there is a hex key 7 accepting first slot 3 providing access to a plurality of channels 6 of different cross-sectional sizes, extending longitudinally into the body 40. The channels 6 extend into the interior of the body, through the middle portion of the body, parallel to the length of the body, and are of sufficient width to allow various-sized hex keys to be inserted therethrough. Each channel is open at the bottom of the body so as to allow hex keys to extend downwardly therefrom, once hex keys are inserted into hex key slots, as discussed below.

Figure 12:
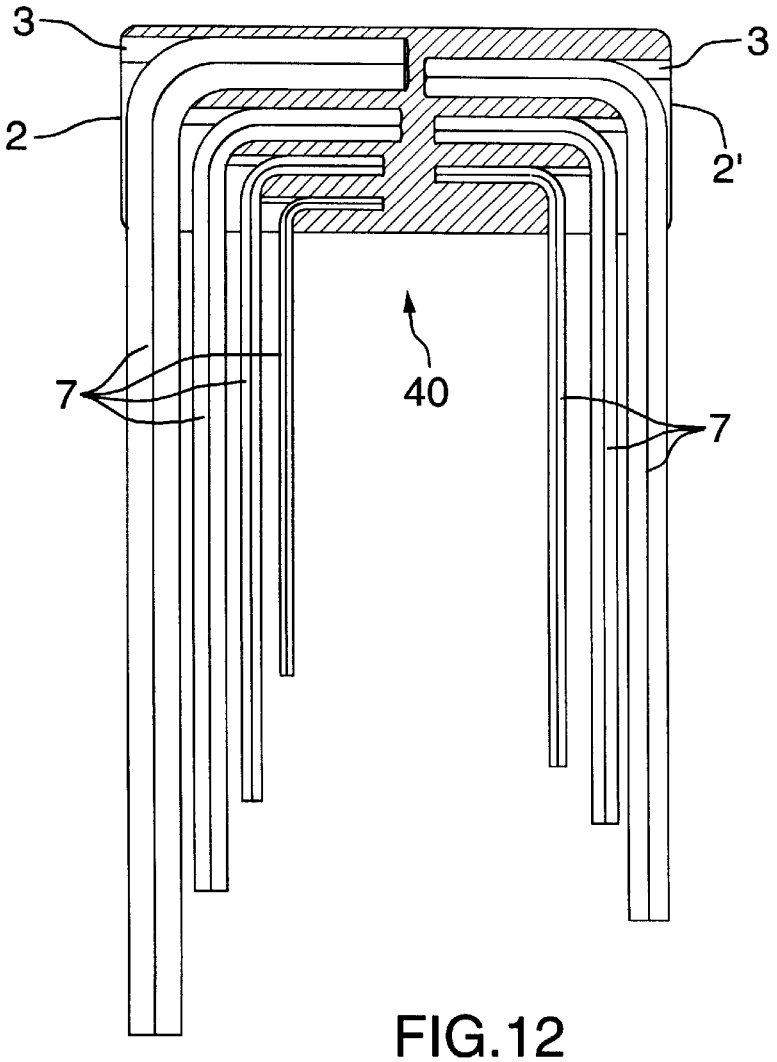
FIG. 12 is a sectioned side view of the second preferred embodiment, showing seven hex keys stored therein.
Figure 13:
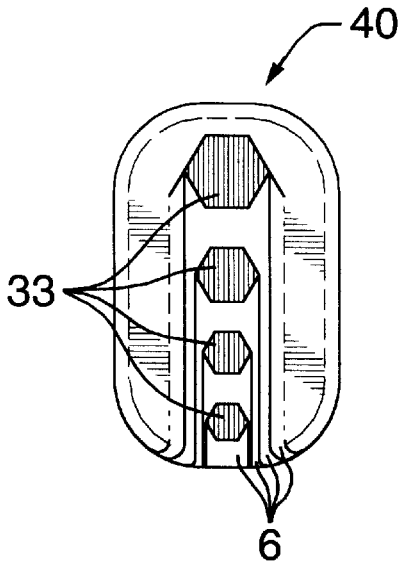
FIG. 13 is an end view of the first end of the second preferred embodiment.
Figure 14:
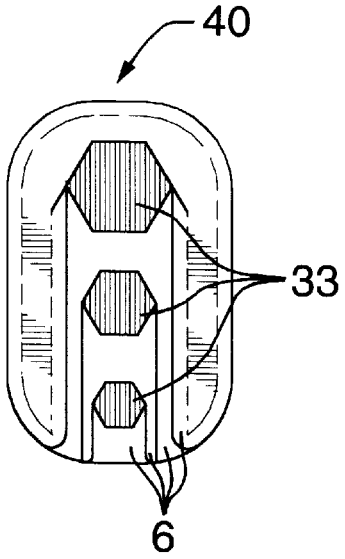
FIG. 14 is an end view of the second end of the second preferred embodiment.

As shown in FIGS. 12, 13 and 14, hex key cavities 33 are located within each channel 6, extending into the body parallel to the length of the body. The first end 2 has four hex key cavities 33 in its hex key accepting channels 6 and the second end 2' has three hex key cavities in its channels. Each hex key cavity is sized and shaped to accept a specific sized hex key. A second slot 32 is arranged longitudinally in the side of the elongated body 40, to allow access to the plurality of channels from the side of the body. The largest hex key cavity on each side is located farthest from the second slot. The cavities are placed within the channels in order of descending size from top to bottom. Each cavity extends to approximately the middle of the body. The cavity designed to accept the largest hex key 7 is offset from the side of the body a distance equivalent to the cross section of the cavity. The opening of the next largest cavity is offset from the opening of the largest cavity a distance equivalent to the cross section of that next largest cavity. The opening of each cavity is offset from the opening of the larger cavity immediately above it a distance equivalent to the cross section of the cavity itself.

The shape of each cavity is oriented so that when one arm of the hex key is inserted into its cavity, its other arm extends downward through the hex key accepting channel, perpendicular to the length of the body.

As shown in FIG. 12, to use the body to store hex keys, the smallest hex key is placed in its applicable cavity such that the short arm of the hex key is inserted into its cavity so that the perpendicular long arm extends through the second slot 32. Each hex key is inserted smallest to largest, until each cavity has a hex key inserted into it. The body can then be attached to a display holder if desired, for example by means of the holes 17. Hex keys are removed from storage by disengaging the body from the display holder and then removing the hex keys, preferably from largest to smallest.

Figure 15:
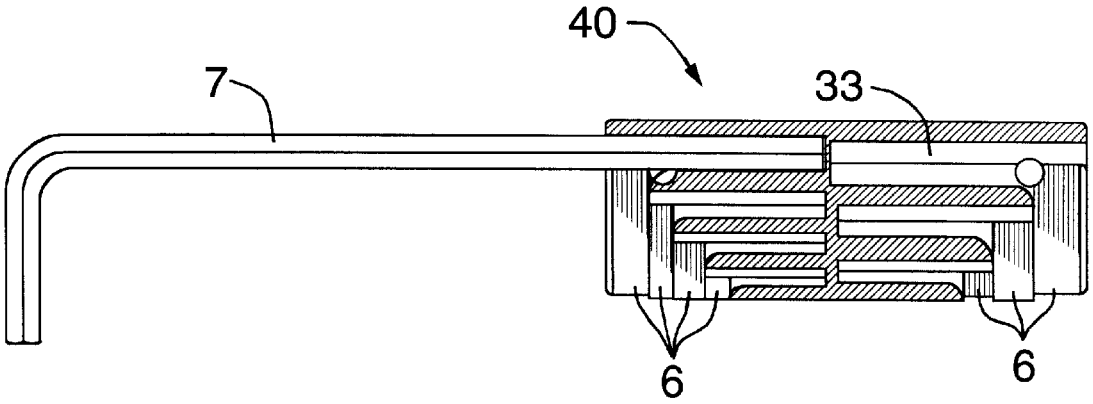
FIG. 15 is a sectioned side view of the second preferred embodiment, showing the long portion of a hex key inserted therein.

As shown in FIGS. 15, to use the second embodiment for additional torque when using a hex key, a hex key is inserted into the cavity sized to receive it. The long arm of the hex key is inserted in FIG. 15, but the short arm of the hex key may be inserted instead. The cross section of each cavity is such that the applicable hex key will fit tightly into the cavity, so that the hex key will not rotate once inserted. The length of the cavity is such that once the hex key is inserted thereto, it will not inadvertently come out of the cavity, unless it is intentionally removed therefrom. In order to provide the maximal leverage, the long arm of the hex key is inserted into the cavity, with the short arm extending downward from the body through the hex key accepting channel. The body can be used to exert additional torque when using the inserted hex key, or to provide additional grip for securely gripping the hex key. The second embodiment of the device must be made of a sufficiently strong material, preferably plastic, and be of sufficient width to adequately act as a lever. The hex key accepting cavities may be reinforced with further rigid material, such as glass, in order to ensure that the cavities do not deform when the body is used as leverage for using a hex key.

Third Embodiment

A third preferred embodiment is shown in FIGS. 16A to 19. Reference numerals have been used corresponding to those of FIGS. 1 to 10 for the same technical features. The device has an elongated body 40 comprising a first end 2 and an opposite second end 2'. The first end has a first slot 3 providing access to a plurality of channels 6 of different cross-sectional sizes, extending longitudinally into the body. A second slot 32 is arranged longitudinally in the side of the elongated body 40, to allow access to the plurality of channels from the side of the body. The channels are sequentially arranged in a direction from the first end 2 towards the second slot 32, in order of increasing width. Each of the plurality of channels 6 comprises a first wall surface 30 and a second wall surface 31. The first wall surface and the second wall surface cooperate to create contact surfaces for cooperating with the sides of the hex key. Thus, there is a "stepped" configuration of channels 6 within the first slot 3. When a hex key 7 is inserted into the applicable channel 6, the inserted portion of the hex key extends parallel to the length of the body, and thus the operable perpendicular portion of the hex key extends laterally, i.e. perpendicular to the length of the body, extending through its respective channel 6 and thence away from the body.

Figure 16A:
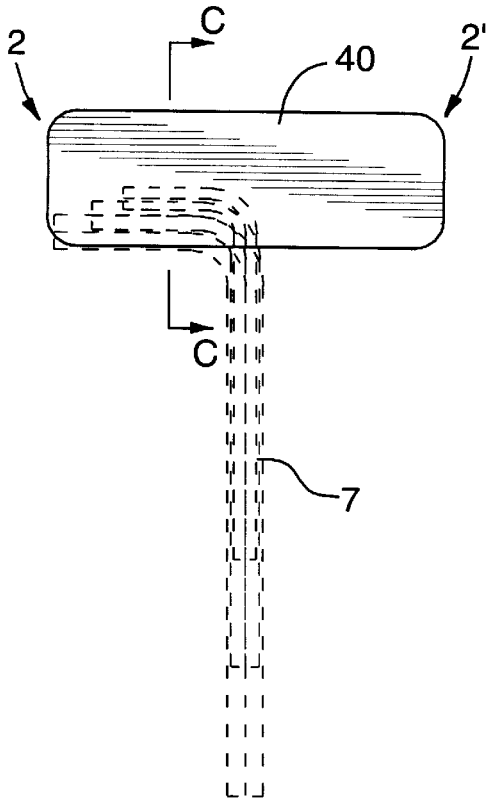
FIG. 16A is a side view of a third preferred embodiment of the invention.
Figure 19:
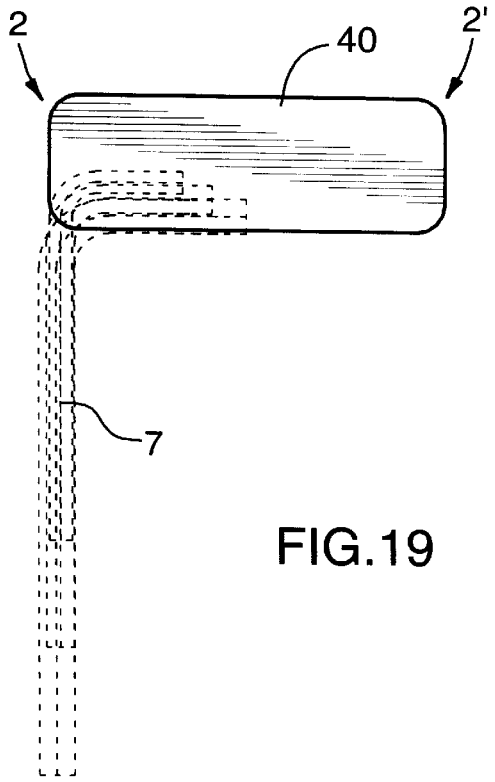
FIG. 19 is a side view of the third preferred embodiment, but where the hex key is arranged to protrude from the end part of the device.
Figure 18:
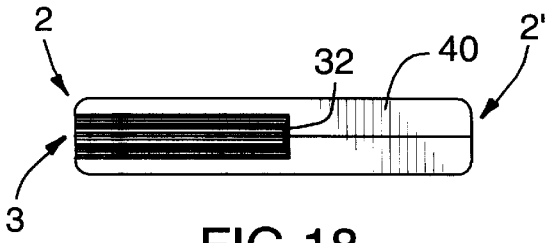
FIG. 18 is a bottom view of the third preferred embodiment.
Figure 17:
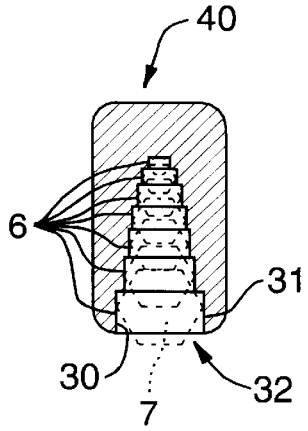
FIG. 17 is a cross section at line C—C of FIG. 16A.
Figure 16B:
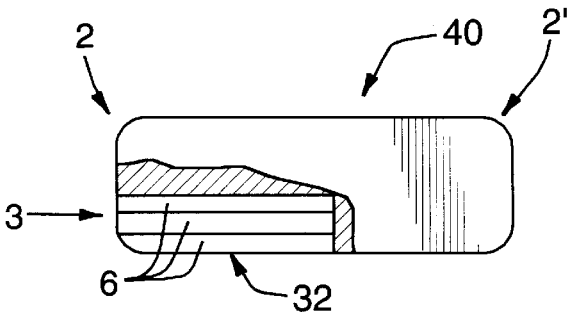
FIG. 16B is a partially sectioned side view of the embodiment according to FIG. 16A.

As is shown in FIGS. 16A and 19, a hex key 7 may be inserted into the body 40 either with its protruding portion emanating from a central part of the body (FIG. 16A), or with its protruding portion emanating from the first end 2 portion of the body (FIG. 19). The chosen method of inserting the hex key depends on the desired amount of torque necessary to be transmitted to the hex key via the body 40. The first alternative is chosen for lower torque applications, whereas the second alternative is chosen for higher torque applications.

Fourth Embodiment

Figure 21:
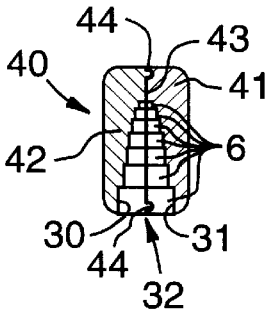
FIG. 21 is a cross section at line D—D of FIG. 20.
Figure 20:
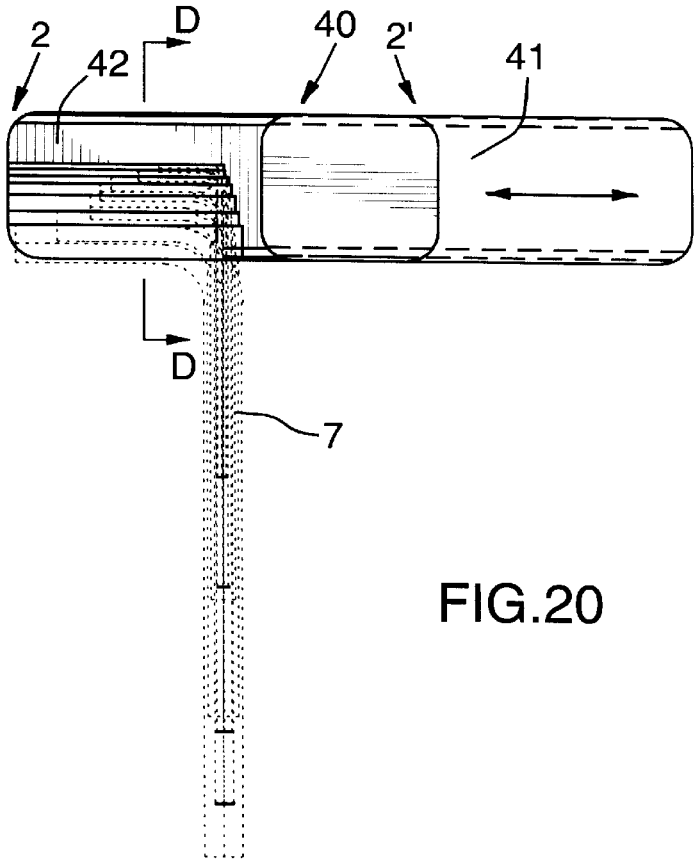
FIG. 20 is a side view of a fourth preferred embodiment of the invention.
Figure 22:
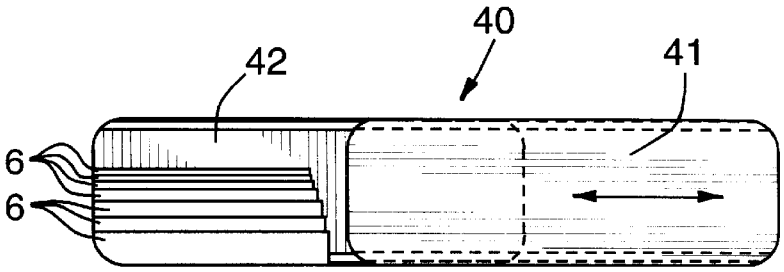
FIG. 22 is a side view of the fourth preferred embodiment, without an inserted hex key.

A fourth preferred embodiment is shown in FIGS. 20 to 22. Reference numerals have been used corresponding to those of FIGS. 1 to 10 for the same technical features. The device has an elongated body 40 comprising a first end 2 and an opposite second end 2'. The first end has a first slot 3 providing access to a plurality of channels 6 of different cross-sectional sizes, extending longitudinally into the body. A second slot 32 is arranged longitudinally in the side of the elongated body 40, to allow access to the plurality of channels from the side of the body. The channels are sequentially arranged in a direction from the first end 2 towards the second slot 32, in order of increasing width. Each of the plurality of channels 6 comprises a first wall surface 30 and a second wall surface 31. The first wall surface and the second wall surface cooperate to create contact surfaces for cooperating with the sides of the hex key. Thus, there is a "stepped" configuration of channels 6 within the first slot 3. When a hex key 7 is inserted into the applicable channel 6, the inserted portion of the hex key extends parallel to the length of the body, and thus the operable perpendicular portion of the hex key extends laterally, i.e. perpendicular to the length of the body, extending through its respective channel 6 and thence away from the body. The body 40 further comprises a first half 41 and a second half 42. The first body half has a sliding surface 43 on which the second body half may reciprocally slide in the longitudinal direction of the body 40. Guiding and holding means 44 are arranged on the first and the second body half, to prevent the two halves from sliding in any other directions and to prevent them from parting. To insert a hex key in the body of the fourth preferred embodiment, the two body halves are slid from a closed position, where the ends of the two body halves line up with each other, to an opened position, where the two body halves are slid apart to reveal the channels 6 of the second body half 42. A hex key is inserted into its corresponding channel and the first body half 41 is slid to the closed position, thereby squeezing the hex key 7 in the corresponding channel. As explained for the third preferred embodiment, the hex key may be inserted into the body 40 either with its protruding portion emanating from a central part of the body (FIG. 20), or with its protruding portion emanating from the first end 2 portion of the body (not shown).

Fifth Embodiment

Figure 23:
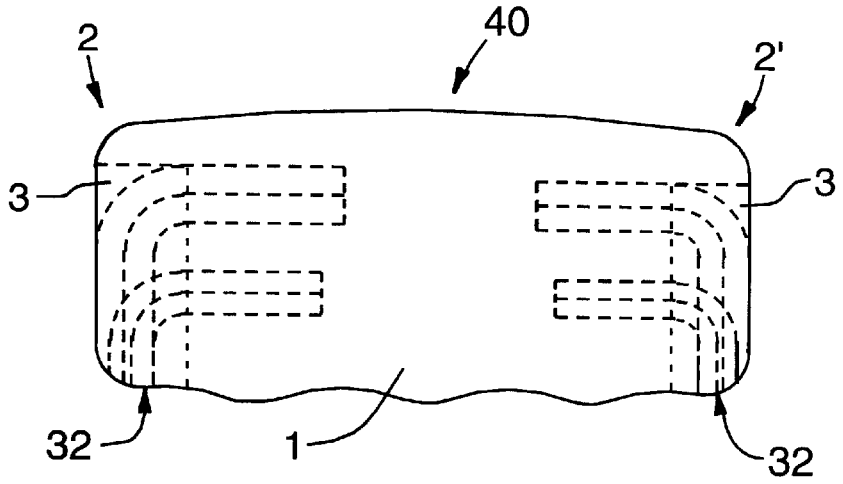
FIG. 23 is a sectional side view of a fifth preferred embodiment of the invention.
Figure 24:
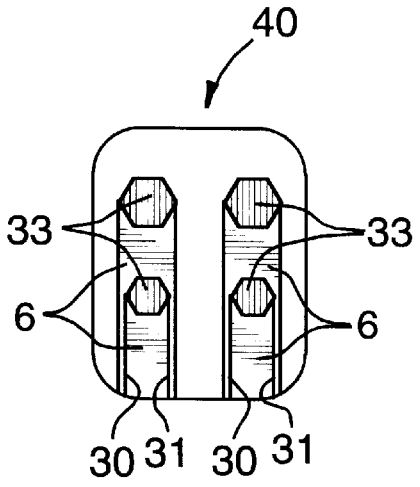
FIG. 24 is an end view of the fifth preferred embodiment.
Figure 25:
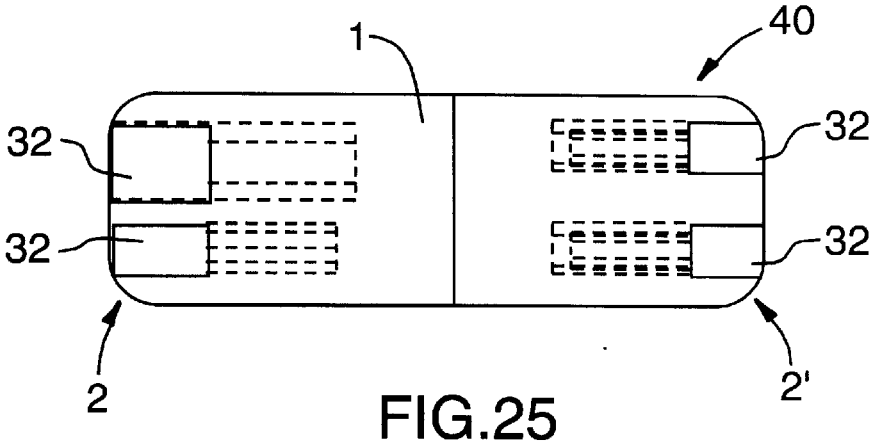
FIG. 25 is a bottom view of the fifth preferred embodiment.
Figure 26:
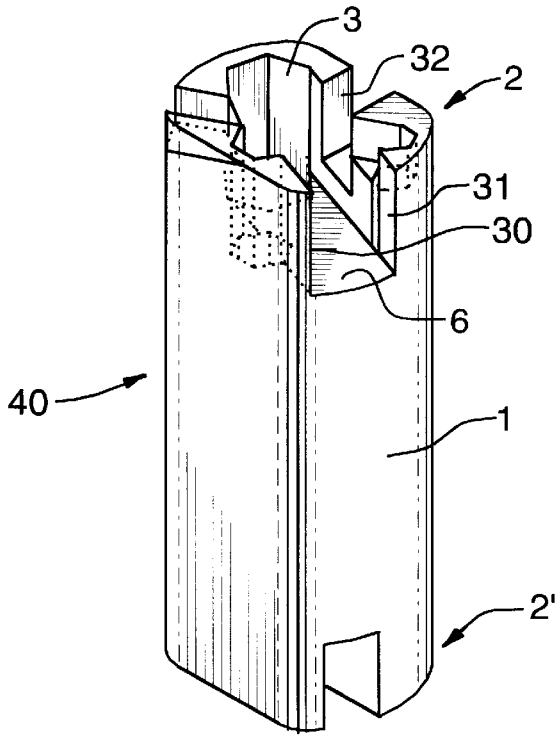
FIG. 26 is a perspective view of a sixth preferred embodiment of the invention.
Figure 27:
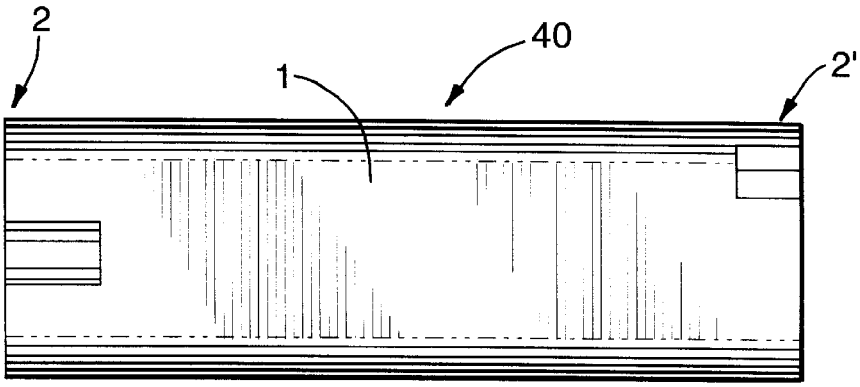
FIG. 27 is a side view of the sixth preferred embodiment.
Figure 28A:
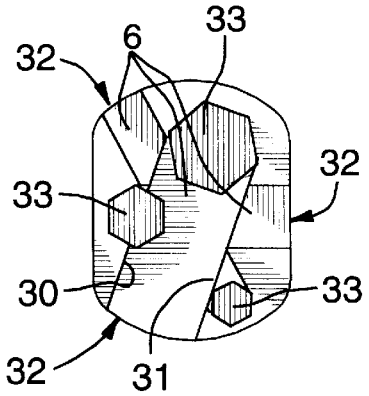
FIG. 28A is an end view of the first end of the sixth preferred embodiment.
Figure 28B:
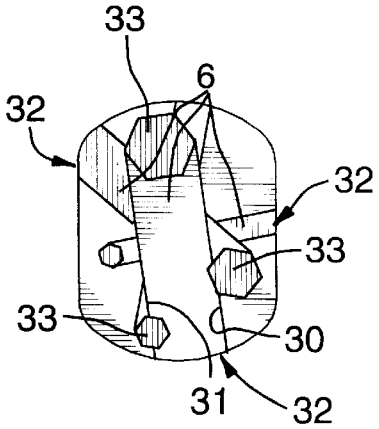
FIG. 28B is an end view of the second end of the sixth preferred embodiment.

A fifth preferred embodiment is shown in FIGS. 23 to 25. Reference numerals have been used corresponding to those of FIGS. 1 to 10 for the same technical features. The device has an elongated body 40 comprising a central grip portion 1 and one first end 2 and an opposite second end 2'. One or preferably both ends have at least one first slot 3 providing access to a plurality of channels 6 of different cross-sectional sizes, extending longitudinally into the body. A second slot 32 is arranged longitudinally in the side of the elongated body 40, to allow access to the plurality of channels from the side of the body. The channels are sequentially arranged in a direction from the respective end towards the second slot 32, in order of decreasing width. Each of the plurality of channels 6 comprises a first wall surface 30 and a second wall surface 31. The first wall surface and the second wall surface cooperate to create contact surfaces for cooperating with the sides of the hex key. A cavity 33 is arranged in each of the plurality of channels 6, and each cavity runs longitudinally into the body. Each cavity is arranged to receive one arm of a hex key (not shown). Preferably there are as many cavities as channels at each end 2, 2', and the cavities are generally longitudinally aligned with each other and have a respective width corresponding to the diameter of their corresponding hex key. The cross-section of the cavities 33 is preferably hexagonal, but any cross-section which corresponds to the intended inserted tool may be used.

Sixth Embodiment

A sixth preferred embodiment is shown in FIGS. 26 to 29C. Reference numerals have been used corresponding to those of FIGS. 1 to 10 for the same technical features. The device has an elongated body 40 comprising a central grip portion 1 and one first end 2 and an opposite second end 2'. One or preferably both ends have at least one first slot 3 providing access to a plurality of channels 6 of different cross-sectional sizes, extending longitudinally into the body. A plurality of second slots 32 are arranged longitudinally in the sides of the elongated body 40, to allow access to the plurality of channels from the side of the body. Each channel thus has a corresponding second slot. Each of the plurality of channels 6 comprises a first wall surface 30 and a second wall surface 31. The first wall surface and the second wall surface cooperate to create contact surfaces for cooperating with the sides of the hex key. A cavity 33 is arranged in each of the plurality of channels 6, and each cavity runs longitudinally into the body. Each cavity is arranged to receive one arm of a hex key, and the orifice 32 is arranged to guide the other arm of the hex key, thus holding the hex key in a steady grip in the body 40. Preferably there are as many cavities as channels at each end 2, 2', and the cavities are generally longitudinally aligned with each other and have a respective width corresponding to the diameter of their corresponding hex key. The cross-section of the cavities 33 is preferably hexagonal, but any cross-section which corresponds to the intended inserted tool may be used.

Figure 29A:
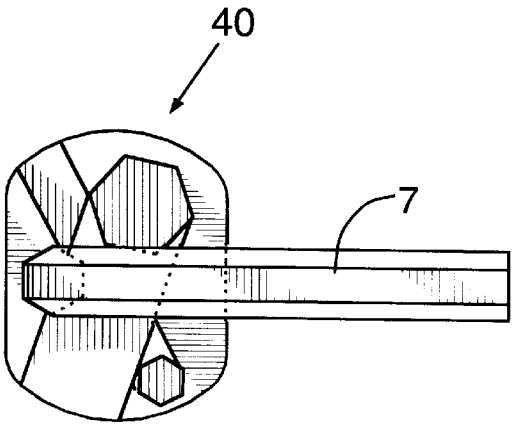
FIG. 29A is an end view of the first end of the sixth preferred embodiment, showing a medium hex key inserted into the device.
Figure 29B:
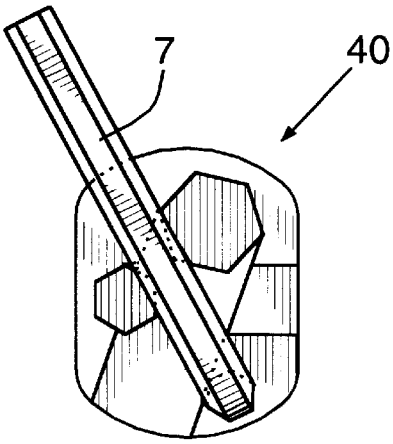
FIG. 29B is an end view of the first end of the sixth preferred embodiment, showing a small hex key inserted into the device.
Figure 29C:
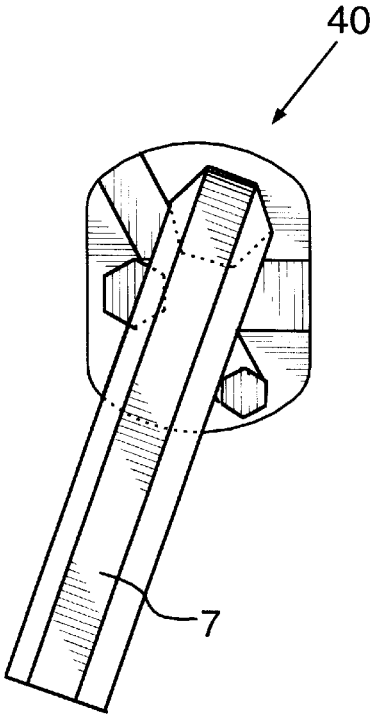
FIG. 29C is an end view of the first end of the sixth preferred embodiment, showing a large hex key inserted into the device.

As is shown in FIGS. 29A to 29C, hex keys of different sizes are inserted into the corresponding channel 6 having the corresponding size cavity 33. The other arm of the hex key 7 is put in the channel 6 so that it exits the body 40 via the corresponding orifice 32.

It will be appreciated that the above description relates to the preferred and alternative embodiments by way of example only. Many variations on the invention will be obvious to those knowledgeable in the field, and such obvious variations are within the scope of the invention as described and claimed, whether or not expressly described.

What is claimed as the invention is:

1. A device for assisting in gripping and applying the torque to a hex key, comprising an elongated body having a central grip portion, a first end and a second end, wherein at least one of said first and second ends has at least one first slot providing access to a plurality of lateral channels in said body, said channels having various cross-sectional sizes and being stepped sequentially into said body from said at least one of said ends, each said channel having internal walls defining contact surfaces for contacting sides of said hex key, and wherein said body has at least one second slot in a side adjacent at least one of said first and second ends having said at least one first slot, aligned with said channels.

2. A device as claimed in claim 1, further comprising a plurality of longitudinal cavities at each of said plurality of channels, there being one said channel for each said cavity, said channels being generally laterally aligned with each other and each having a respective width corresponding to the width of their corresponding cavity, said sequential stepping of said channels being in order of decreasing width.

3. A device as recited in claim 2, where said first end and said second end is are substantially cylindrical, at least one of said first and second ends, said collar having an exterior and interior surface and an opening extending through a portion of said collar; said collar being rotatable around the respective end of the body from hex key accepting positions to hex key locking positions; said hex key accepting positions being said where said opening is aligned with a given said cavity allowing a hex key to be inserted into said given cavity; said locking positions being where said collar is rotated around said end of the body such that an edge of said collar opening presses against a hex key which is inserted into a given said cavity in the body.

4. A device as recited in claim 3, where said at least one collar has at least one V-shaped notch located along a side edge of said opening, said at least one v-shaped notch being shaped to accept two side edges of said hex key once said hex key is inserted into said corresponding cavity and said collar is rotated to the hex key locking position, such that once said side edge of said opening is pressed against the hex key, the key cannot move relative to the body until the collar is rotated from the hex key locking position.

5. A device as recited in claim 3, where said collars are attached to the body by means of a tongue on the interior surface of each said collar, wherein said tongue extends around the circumference of the side of each said collar and said tongue being aligned to be inserted into a corresponding groove located on the side of the body, adjacent to each said end of the body, such that when said tongue and groove are aligned, each said collar is prevented from disengaging from said body and said collar remaining free to rotate from said hex key accepting positions to hex key locking positions.

6. A device as recited in claim 2, where bottom ends of said cavities are arranged at substantially the same depth inside said body such that the device is adapted for accepting and storing hex keys with the smallest cross-section hex keys protruding a short distance from said body and the largest cross-section protruding a larger distance from said body to enable all hex keys to be inserted into respective cavities and stored in the device without contact between individual hex keys.

7. A device as recited in claim 6, where said body comprises a substantially rectangular block piece.

8. A device as recited in claim 2, where said first end has three cavities, arranged in descending order of cross sectional size, across the diameter of said first end and said second end has four cavities arranged in descending order of cross sectional size, across the diameter of said second end.

9. A device as recited in claim 1, where said body further comprises means for detachably securing said body to a point-of-sale display holder.

10. A device as recited in claim 1, where said attaching means comprises at least one hole on one side of said body adapted to receive a post extending from said point-of-sale display holder.

11. A device as recited in claim 8, where said attaching means comprising at least one aperture on a side of said body, shaped and positioned to receive at least one post on a display piece.

12. A device as recited in claim 1, where said body further comprises a first half and a second half, wherein said first body half has a sliding surface on which the second body half may reciprocally slide in a longitudinal direction of the body, and guiding and holding means are arranged on the first and the second body half, to prevent the two halves from sliding in any other directions and to prevent them from parting, so that to insert a hex key in said body, the two body halves are slid from a closed position, where the ends of the two body halves line up with each other, to an opened position, where the two body halves are slid apart to reveal said channels, said hex key is then inserted into its corresponding channel and the first body half is slid to the closed position, thereby capturing the hex key in the corresponding channel.

* * * * *